US011421457B2

(12) United States Patent
Dreisewerd

(10) Patent No.: US 11,421,457 B2
(45) Date of Patent: Aug. 23, 2022

(54) HINGE

(71) Applicant: Nikolaus Dreisewerd, Rietberg (DE)

(72) Inventor: Nikolaus Dreisewerd, Rietberg (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 429 days.

(21) Appl. No.: 16/736,908

(22) Filed: Jan. 8, 2020

(65) Prior Publication Data

US 2020/0224471 A1 Jul. 16, 2020

(30) Foreign Application Priority Data

Jan. 10, 2019 (DE) ..... 102019100538.8

(51) Int. Cl.
*E05D 3/06* (2006.01)
*E05D 5/02* (2006.01)

(52) U.S. Cl.
CPC ..... *E05D 3/06* (2013.01); *E05D 5/0215* (2013.01); *E05Y 2201/624* (2013.01);
(Continued)

(58) Field of Classification Search
CPC .... E05D 3/06; E05D 3/12; E05D 3/14; E05D 3/142; E05D 3/16; E05D 3/125; E05D 3/127; E05D 3/185; E05D 3/186; E05D 7/04; E05D 7/0423; E05D 7/0415; E05D 7/043; E05D 7/0027; E05D 7/0045; E05D 5/02; E05D 5/0215; E05D 5/062; E05D 2007/0438; E05D 2007/0446; E05D 2007/0453; E05D 2007/0461; E05D 2007/0469; E05D 2007/0476; E05D 2007/0484; E05D 2007/0492; E05D 9/00; E05Y 2600/41; E05Y 2600/634; E05Y 2600/412; E05Y 2600/45; E05Y 2600/452; E05Y 2600/46; E05Y 2600/51; E05Y 2900/132; E05Y 2900/20; E05Y 2900/50;
(Continued)

(56) References Cited

U.S. PATENT DOCUMENTS 1,772,559 A * 8/1930 Soss ..... E05D 3/14 16/379
2,570,479 A 1/1947 Pollman
(Continued)

FOREIGN PATENT DOCUMENTS

DE 102011051190 B3 * 7/2012 ..... E05D 3/186
EP 1577474 A2 * 9/2005 ..... E05D 11/1007
(Continued)

*Primary Examiner* — Chuck Y Mah
(74) *Attorney, Agent, or Firm* — Andrew Wilford

(57) ABSTRACT

A hinge supports a door panel having a door edge in a door frame having a frame edge in a closed position of the door. A door part fixed to the door edge defines first and second parallel door axes in the gap between the door edge and frame edge, and a frame part fixed to the frame edge defines first and second parallel frame axes recessed in the door frame. A first link has one end pivoted on the door panel at the first door axis and an opposite end pivoted on the frame part at the first frame axis, and a second link separate from the first link has one end pivoted on the door part at the second door axis and an opposite end pivoted on the frame part at the second frame axis.

20 Claims, 6 Drawing Sheets

(52) U.S. Cl.
CPC ..... *E05Y 2600/41* (2013.01); *E05Y 2600/51* (2013.01); *E05Y 2900/132* (2013.01)

(58) Field of Classification Search
CPC ..... E05Y 2900/531; E05Y 2900/546; E05Y 2201/624; E05Y 2201/638; E05Y 2800/45; E05Y 2800/674
See application file for complete search history.

(56) References Cited

U.S. PATENT DOCUMENTS

| | | | | |
|---|---|---|---|---|
| 6,829,808 | B2 | 12/2004 | Neukoetter | |
| 2015/0259960 | A1* | 9/2015 | Smith | E05D 3/142 16/250 |
| 2018/0195328 | A1 | 7/2018 | Gorenbacher | |
| 2018/0216379 | A1* | 8/2018 | Spoelstra | E05D 5/06 |
| 2018/0252011 | A1* | 9/2018 | Yamaguchi | E05D 5/0246 |
| 2019/0071904 | A1* | 3/2019 | Migliorini | E05D 7/0415 |
| 2019/0186185 | A1* | 6/2019 | Todd | E05D 11/0018 |

FOREIGN PATENT DOCUMENTS

| | | | | |
|---|---|---|---|---|
| EP | 1754848 | A2 * | 2/2007 | E05D 3/186 |
| WO | WO-2013179326 | A1 * | 12/2013 | E05D 3/183 |
| WO | WO-2019172787 | A1 * | 9/2019 | E05D 7/0415 |

* cited by examiner

HINGE

FIELD OF THE INVENTION

The present invention relates to a hinge assembly. More particularly this invention concerns a hinge assembly for recessing in a door jamb.

BACKGROUND OF THE INVENTION

The invention relates to a building door with a door frame, a door panel, and a door hinge, the door hinge having a frame part and a door part that are connected to one another by a first hinge link and a second hinge link, the door hinge, starting from the closed position, having an opening angle of at least 135° upon reaching a maximum open position, the hinge links forming a 4-axis hinge assembly in which the first hinge link is attached to the frame part so as to be rotatable about a first hinge axis and to the door part so as to be rotatable about a first door axis, and the second hinge link being attached to the frame part so as to be rotatable about a second hinge axis and to the door part so as to be rotatable about a second door axis, the two hinge links not being directly connected to one another.

Various hinge constructions are known for different applications. The present invention relates specifically to a building door, in which context it is necessary for the door hinge to be able to carry the weight and absorb the forces exerted by the door panel. A corresponding door panel usually has a surface area of at least 1 $m^2$ and weighs at least 10 kg. Building doors include street doors, residential closure doors or entry doors, or also interior doors.

Against this background, the door hinge must have sufficient stability on the one hand; on the other hand, an inconspicuous appearance is often required of the door hinge so that the building door composed of a door panel, a door frame, and usually at least two door hinges fits well into a surrounding wall surface and has a high-quality appearance. To achieve this, the door hinge is usually arranged in a manner as to be concealed between the door panel and door frame, with various concepts having emerged for this purpose in the past.

For instance, U.S. Pat. No. 6,829,808 describes a concealed door hinge that is inserted into the edge of a door panel and the edge of a door frame and is not visible when the door is closed. The two hinge links are guided at one of their ends so as to be rotatable about a vertical axis of rotation and at their other end so as to be longitudinally displaceable and rotatable. Furthermore, the two hinge links are connected to the ends of connecting central portions about an additional vertical axis of rotation to one another, so that a 5-axis hinge assembly is produced overall in which two of the hinge axes are additionally guided along slotted guides.

For example, a building door with a 4-axis hinge assembly of this generic type is known from US 2018/0195328 where, in particular, a door frame made of glass is attached in a compact manner to the door part. A clamping device is provided for this purpose into which the glass door is inserted and fixed by a clamp that exerts pressure on the door panel surface. This makes it possible to fix the door panel without drilling holes in the glass door.

In order to enable an opening or closing movement, a recess is also provided in a mirror portion of the door frame through which the clamping device is passed in part during the opening or closing movement. A pivoting movement would be blocked without this recess, so the door frame must be manufactured accordingly prior to installation of the door hinge. Moreover, this door hinge was also suitable only for use on glass doors. The mounting of standard wooden doors or doors made of aluminum profiles is not possible due to the thickness.

U.S. Pat. No. 2,570,479 also describes a building door of this generic type with 4-axis kinematics in which the door part and the frame part are inserted into respective recesses of the door frames and door panel and then attached thereto. These recesses are usually made in the form of mortises that require very time-consuming work steps. However, it is possible for a door gap with a small gap dimension to be formed between the door panel and the door frame in the closed position that can be additionally concealed by a door panel-side rebate.

Overall, however, the known door hinges for building doors have room for improvement.

OBJECTS OF THE INVENTION

It is therefore an object of the present invention to provide an improved hinge assembly.

Another object is the provision of such an improved hinge assembly that overcomes the above-given disadvantages, in particular whose door hinge is versatile and has a compact construction on the one hand while being easily installable on the other hand.

SUMMARY OF THE INVENTION

A hinge assembly pivotally supports a door panel having a door edge in a door frame having a frame edge juxtaposed with and confronting the door edge in a closed position of the door with the door and frame edges delimiting a gap. The hinge has a door part fixed to the door edge and defining first and second parallel door axes in the gap between the door edge and frame edge and a frame part fixed to the frame edge and defining first and second parallel frame axes recessed in the door frame and offset from the gap. A first link has one end pivoted on the door panel at the first door axis and an opposite end pivoted on the frame part at the first frame axis, and a second link separate from the first link has one end pivoted on the door part at the second door axis and an opposite end pivoted on the frame part at the second frame axis. The two links are not connected to each other directly or indirectly between their ends. Thus the door is pivotal from the closed position through at least 135° to an open position.

By fastening the door part to the door edge, in the closed position the door part does not extend out of the door gap in a first horizontal direction perpendicular to the door panel. In the closed position, all of the components of the door part are thus located between planes that are defined by the front and rear faces of the door panel. The frame part is also preferably between these planes in the closed position, thus concealing the door hinge by simple means. A recessed or flush door is ideal for this purpose, for example. Alternatively, a special means of concealment can be attached to the door panel even after installation.

The door frame can also have a lip covering the gap at the back face of the door panel. Preferably, the door panel then moves away from this lip during opening. In the closed position, the door panel can then rest against the door frame via the lip. If both the door panel and the door frame each have a lip, the door hinge can be concealed from sight from both sides of the building door when in the closed position.

Moreover, it is essential to the invention that the door axles be within the door gap between the door panel and door frame in the closed position. The invention departs in this respect from known door hinges in which the door part is inserted into a recess or milled cutout on the door edge, in which case the door axles are then also recessed in the door panel. By virtue of the compact design of the door hinge, such a configuration is not required, so that the door gap that is already provided is sufficient for receiving the door axes, which are usually formed by rotatable bolt or pin connectors.

Preferably, not only the door axes are in the door gap, but rather the entire door part. This makes fitted mounting on the edge of the door possible, without the need for previous processing in the form of mortices, for example. Instead, the door part can be attached in a simple manner, for example by screwing, to a flat door edge without previous processing steps.

The assembly of the door axes or the overall assembly of the door part within the door gap is made possible not only by the compact design of the door part, but also by the special design of the hinge link and frame part. As a result, a large portion of the hinge link is in the frame part and/or in the door frame in the closed position, so that only a small portion of the hinge link needs to be accommodated within the door gap. This is all the more important because the door gap preferably has a gap dimension of less than 15 mm, preferably less than 12 mm.

It has been found to be especially advantageous if the door hinge is used in a building door whose door frame is a hollow profile. Hollow profiles are usually made of aluminum and offer the advantage that they already have a chamber for insertion of the frame part. Such a door frame need therefore be milled only on the reveal-side wall, it then being possible for the frame part to be inserted and attached to the edge. The cavity then provides adequate space for the hinge link in the closed position, so that when choosing a suitable hollow profile, a rear limiting of the door hinge that would also limit pivoting of the hinge link is not required.

It is also possible for the door panel to be composed of a hollow profile that is made of aluminum, for example. Alternatively, however, other doors such as standard wooden doors or wooden doors with a false edge can also be used.

If the door has a recess in which the door hinge is recessed in the closed position, a lip extending vertically along the groove is preferably provided on the lip into which a sealing strip is inserted that is pressed against the door frame in the closed position. For this purpose, the door frame preferably has a recess that extends along the vertical direction, the depth of which is selected such that the door frame and the door panel are arranged in alignment next to one another and form a common flat plane in the closed position.

The invention also relates to a door hinge that is also used between a door panel and door frame. The door hinge thus is installed on a mounting face on the door edge of formed on the door panel. According to the invention, the door axes are in front of the mounting face.

Here, the mounting face or plane is the planar surface on which the frame part can be attached to the door edge or, in the installed state, bears against the door edge. Usually, the mounting plane has a plurality of holes for this purpose into which fasteners such as screws are inserted, the fasteners extending through the holes to behind the mounting plane. In this context, the "rear side" of the mounting plane refers to the side turned toward the door edge in the closed position, and the "front side" refers to the side turned toward the door frame. Even when not installed, the mounting plane as well as the front and rear sides thereof are clearly defined, with the front side facing toward the frame part in the closed position.

Such a configuration makes it possible to provide a door hinge that can be surface mounted.

Despite the surface mounting, however, it of course also lies within the scope of the invention for portions of the leaf portion to be recessed, for example in a mortise cut in the door. Such a configuration may be useful, for example, if additional adjusting means are provided that cannot be implemented due to the compact design of the door hinge. Even with such a configuration, the door axes are still arranged offset outward from the mounting plane.

In the door hinge according to the invention, the frame part and/or the door part can be advantageously made of sheet metal. In contrast to the commonly used manufacturing processes such as injection molding or machining, for example, this makes simple and inexpensive manufacturing possible.

In a preferred development of the invention, a connecting line extends between the centers of the first and the second door axes parallel to the mounting plane in the closed position. Since the mounting plane is usually placed on a door edge parallel thereto, the connecting line between the centers of the first and second door axis extends in an assembled state in the closed position not only parallel to the mounting plane but also to the door edge. The midpoints of the first and the second door axis thus have no offset in a first horizontal direction, although a slight offset is also possible in principle. The angle enclosed by the connecting line and the mounting plane and/or by the connecting line and the door edge is then preferably less than 10°, more preferably less than 5°. Due to this slight or non-existent offset, the frame part can be given a correspondingly narrow construction in the gap direction, and accommodation in the door gap is possible during installation even with small gap dimensions of the gap.

Preferably, the distance between the leaf and the frame part in the gap direction is less than 5 mm in the closed position. In this case, it is also possible for the door part and the frame part to overlap, in which case portions of the door part engage in the frame part or portions of the frame part engage in the door part, or both. The overlap is preferably between 0.1 and 3 mm, for example 1 mm.

In a development of the invention, the frame part has at least one mounting flange but preferably two mounting flanges that attach the frame part to an edge of the door frame. Each of the mounting flanges also has a frame-side mounting plane that abuts against the edge of the door frame in an assembled state. For attachment, holes are usually provided in the mounting flanges into which the fasteners, for example screws, can be inserted, so that a screw to the door frame can be used, for example.

In a preferred development of the invention, a proportion of at least 70% of the first and/or the second hinge link based on the width of the hinge links is behind the frame-side mounting plane of the at least one frame fastening portion in the closed position.

The width of the hinge links corresponds to the maximum spatial extension of the hinge links along a second horizontal direction that extends perpendicular to the leaf-side mounting plane. In the installed state, the second horizontal direction usually corresponds to the gap direction, i.e. to a direction extending perpendicular to the edge of the door frame.

In the closed position, at least 70% of the hinge link or hinge links is thus behind the frame-side mounting plane and thus also in the installed state within the door frame. The rear side of the mounting plane thus faces toward the edge of the door frame, whereas the front of the frame-side mounting plane faces toward the leaf-side mounting plane and, in the installed state, toward the door edge.

A proportion of 70% represents a lower limit here, it being possible for the proportion to be greater than 80% or even greater than 90%. Accordingly, a proportion of no more than 30%, preferably no more than 20%, especially preferably no more than 10% of the first and/or second hinge link based on the width of the hinge links is arranged in front of the frame-side mounting plane of the at least one mounting flange. In the case of a fitted installation of the door hinge on a door edge, this means that no more than 30%, preferably no more than 20%, more preferably no more than 10% of the width of the hinge link is in the door gap.

Preferably, the door part has a plurality of mutually parallel perpendicular tabs, the first and/or the second hinge link being rotatably attached between two perpendicular tabs of the door part. These perpendicular tabs can be produced with particular ease by bending a door part that is formed from sheet metal. The perpendicular tabs as well as the hinge links each have a hole for this purpose, so that given a flush assembly of the holes in the perpendicular tabs and in the respective hinge link relative to one another, a rotatable connection can be produced by insertion of a pivot pin.

Since the perpendicular tabs are preferably arranged completely within the door gap and extend along the gap direction when the door hinge is in the installed state, it is advantageous in terms of achieving the smallest possible gap dimension if the perpendicular tabs of the door part engage at least partially into the frame part in the closed position. As already mentioned, there is a negative distance between the door part and the frame part in the case of such a configuration. The overlap between the leaf and the frame part in the second horizontal direction lies here in a range from 0.1 to 10 mm, preferably in the range from 0.2 to 5 mm, especially preferably in the range from 0.3 to 1 mm.

Preferably, a connecting line between midpoints of the first and second frame axes and connecting line between midpoints of the first and second frame axes form an angle of from 85° to 95°, for example 90°, in the closed position. The two connecting lines are thus nearly or exactly perpendicular to one another. This offers the advantage, for one, that the door axes can be brought as close as possible to the door and, for another, that the frame axes can be brought closer to a lateral frame part wall. Particularly in the case of a frame that is composed of a hollow profile, the available cavity can be exploited to an especially advantageous extent, with the hinge links being able to be in large part within the cavity while simultaneously allowing for a large pivoting movement. It has also proven advantageous for this purpose if, in the closed position, the maximum width of the camber line of the first and/or the second hinge link is greater than the distance between the door part and the frame axis running in the second horizontal direction. Here, the camber line is the line connecting the centers of the circles inscribed in the respective hinge link profile.

In a development of the invention, the door hinge has a third hinge link, in which case the first hinge link is arranged between the second and the third hinge link. Preferably, the third hinge link and the second hinge link are identical. Moreover, all of the above-described features with respect to the first or second hinge link also apply to the third hinge link. In particular, the third hinge link has a third door axis and a third frame axis, the third door axis being in front of the mounting plane and, in the installed state, within the door gap in the closed position. Since the second and third hinge links are identical, the second and the third door axis and the second and the third frame axis coincide, so that a 4-axis hinge assembly is also formed.

In a development of the invention, the frame part has a first and a second end wall and a first and a second mounting flange, with each mounting flange extending from a respective one of the end walls. The first mounting flange can extend from the first end wall. The second mounting flange extends from the second end wall.

In such a configuration, the end walls preferably have a perpendicular tab in a recess of the respective mounting flange. Further, the perpendicular tab and also the respective fastening portion can each have a mutually aligned hole, so that the mounting flange can be clamped to the end walls with the aid of a screw.

In an alternative embodiment, it is also possible for the frame part to be formed in a single piece, with a one-piece design being understood in terms of the invention as an integral design. Here, all of the components of the frame part, in particular the end walls and the mounting flanges, can be formed from only one workpiece. It is also expedient if perpendicular tabs are provided on the end walls, in which case the mounting flanges are formed directly on the perpendicular tabs.

A one-piece design is also expedient for the door part, and the invention also includes door parts that composed of multiple parts.

In addition to the two end walls, the frame part also has at least one middle portion, and in the case of a configuration having two hinge links, the first hinge link is rotatably arranged between a first end wall and the middle portion, and the second hinge link is rotatably arranged between the intermediate web and the second end wall. The invention is not limited to only one intermediate web, however. For instance, in the case of a configuration having three hinge links, a second intermediate web is provided, in which case the first hinge link is then between the two intermediate webs.

Both the side and the intermediate webs are connected to one another at least by a side wall and thereby form an integrally formed portion of the frame part, it being possible for the mounting flanges to be releasably secured thereto. Furthermore, the webs can also be connected to a rear connecting leg, which then limits the frame part to the rear in the direction of the door frame in the installed state. Preferably, however, such a rear-side limit in the form of a connecting wall is not provided if at least two legs are arranged next to one another. This is especially expedient in the case of a door frame that is made from a hollow profile, since the interposed hinge link, for example the first and/or second hinge link, can then enter the cavity freely and utilize same completely even though the frame part continues to have a compact design. In the case of a design having three hinge links, no rear limit is preferably provided between the intermediate webs.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
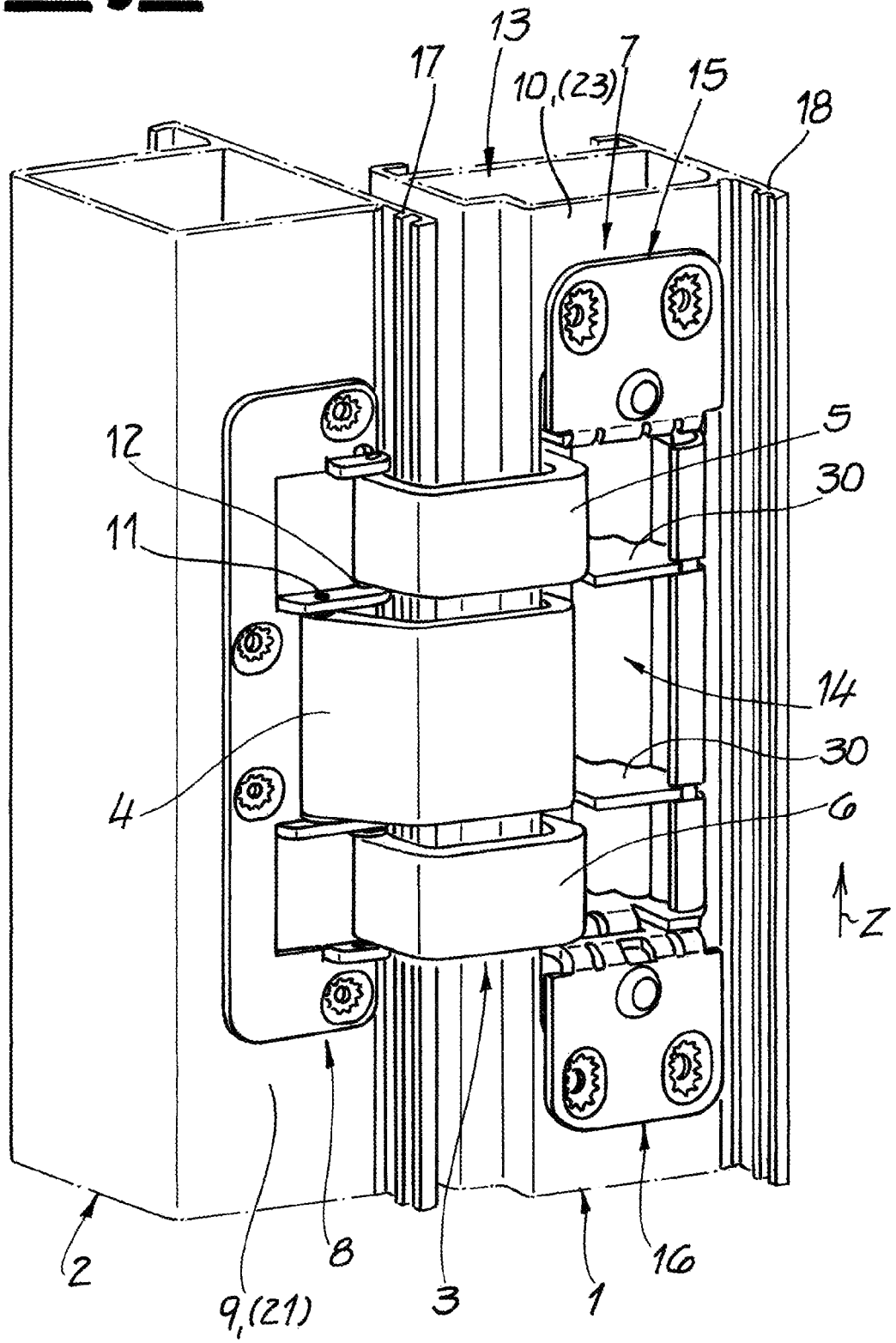
FIG. 1 is a large-scale partly schematic perspective view of a door-hinge assembly according to the invention.

FIG. 1 shows a door frame 1, a door panel 2, and a door hinge 3. The door panel 2 is usually supported on the door frame 1 by at least two of the door hinges 3 shown in FIG. 1, it being noted that FIG. 1 shows only one of these two identical door hinges 3. As also in FIGS. 2A and 2B the door hinge 3 has a 4-axis hinge assembly. Specifically, the door hinge 3 has a first hinge link 4 that is vertically (direction Z) between a second hinge link 5 and a third hinge link 6.

The second hinge link 5 and the third hinge link 6 are identical and also rotatably connected in the same manner to a frame part 7 and to a door part 8. In terms of the movement of the door hinge 3, the second hinge link 5 and the third hinge link 6 behave identically. In principle, an embodiment with only one first hinge link 4 and one second hinge link 5 is sufficient in the context of the invention. The assembly of the second hinge link 5 and the third hinge link 6, which is symmetrical with respect to a horizontal midplane, has been provided for the sake of uniform force distribution and purely for the sake of example.

FIGS. 1 and FIGS. 4A to 4C show how the door hinge 3 has an opening angle of 180° starting from a closed position until a maximum open position is reached.

Figure 2A:
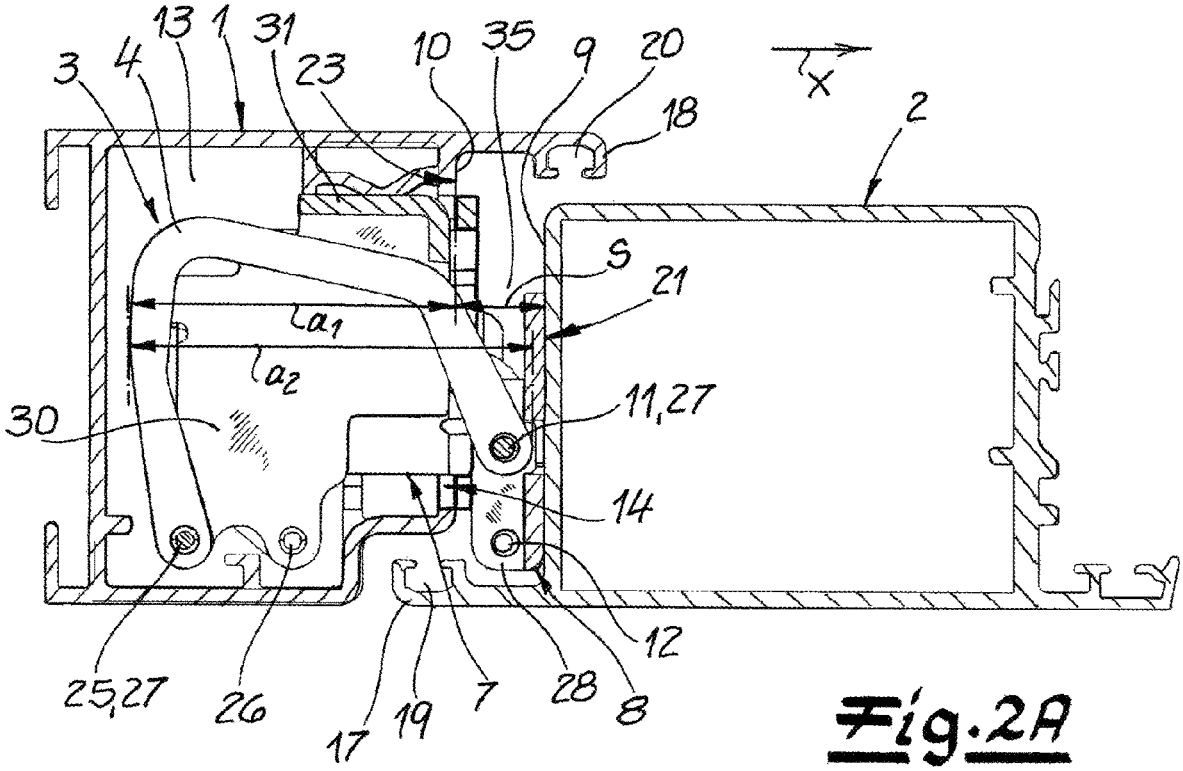
FIGS. 2A, 2B are horizontal sections through the assembly of FIG. 1 with a closed door.
Figure 2B:
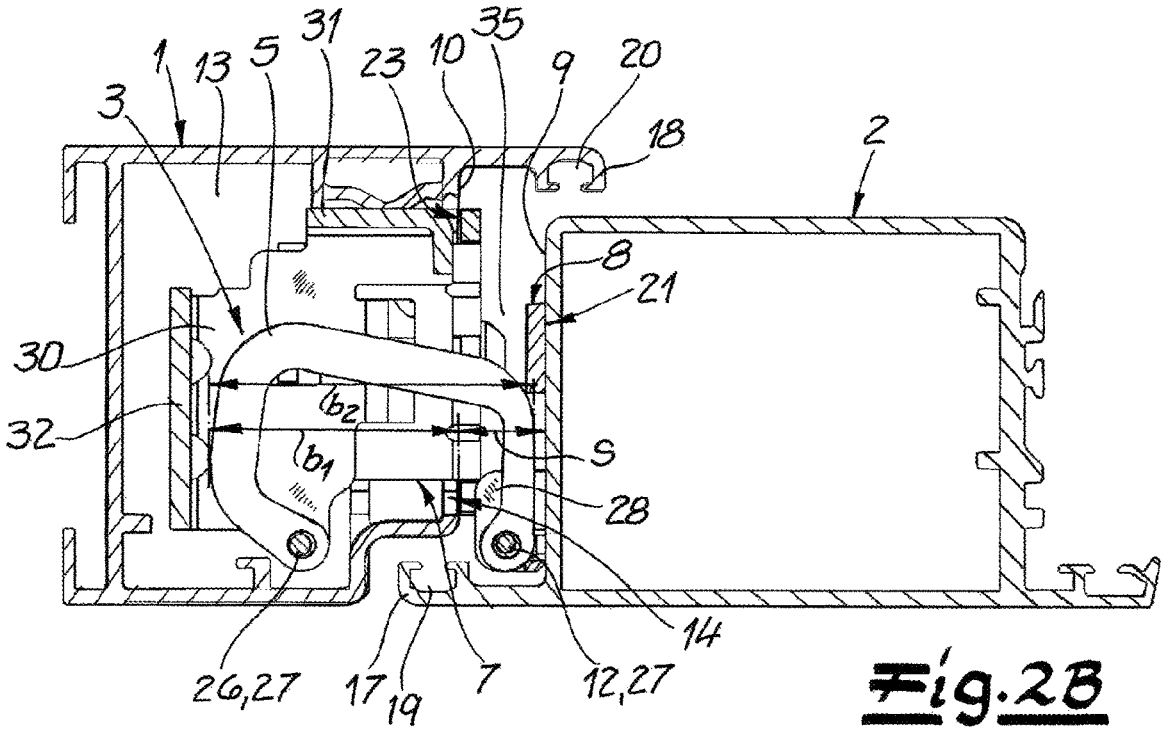

The exact positions of the frame part 7, the door part 8, and the hinge links 4, 5, and 6 when the building door is in a closed position is shown in FIGS. 2A and 2B. Accordingly, the door part 8 is attached to an edge 9 of the door panel 2 and the frame part 7 to an edge 10 of the door frame 1, which edges 9 and 10 are planar, parallel, and confront each other in the closed position. The door frame 1 and the door panel 2 are also spaced apart from one another by a door gap 35 between the door edge 9 and the frame edge 10. This door gap 35 can be seen particularly clearly in the large-scale view of FIG. 3. The first door axis 11 and the second door axis 12 are in the door gap 35 between the door panel 2 and door frame 1. In the illustrated examples, however, not only the door axes 11, 12 are in the door gap 35, but also the entire door part 8, with fasteners for attaching the door part 8 to the door panel 2 not being covered by the frame part 8. A dimension S of the gap 35 is 12 mm, with the frame part 8 extending over a width of 10 mm within the gap 35.

It can also be seen from FIGS. 1 to 4 that both the door frame 1 and the door panel 2 are formed by hollow profiles. Usually, such hollow profiles are made of aluminum, since they can then be extruded and machined in a simple manner on the one hand and have a sufficiently high strength on the other hand. In principle, the building door can also be produced without a door frame 1 and a door panel made of a hollow profile, in which case such a configuration is useful at least for the door frame 1, since a cavity or recess 13 formed on the frame side by the hollow profile is capable of receiving most of the frame part 7 and of the hinge links 4, 5, in the closed position. This can be seen particularly from FIGS. 2A, 2B, and 4A to 4C. The frame part 1 is attached by first and second mounting flanges 15 and 16 that bear directly against the edge 10 of the door frame 1 and are each attached to the door frame 1 by a plurality of fasteners. In the present example, the attachment is achieved by two screws per mounting flange 15, 16.

The door panel 2 has a front lip 17 that is formed on the hollow profile at the outer edge of the panel 1 and that extends parallel to a plane of the panel 2 partly in front of the door frame 1. This lip 17 fulfills two different tasks. A first task is to cover the door gap 35 in the closed position. As a result, not only the door gap 35, but also the door part 8 or portions of the frame part 7 and the hinge link 4, 5, 6 are no longer visible from the outside in the closed position. It is for this reason that the door frame 1 has a rear lip 18 in the present example, so that similar concealment is ensured from both sides of the door.

In addition to concealment, the lips 17, 18 also each have a groove 19, 20 into which an unillustrated seal, for example a seal strip, can be inserted. This seal then abuts against portions of the door frame 1 and/or of the door panel 2 and prevents air flow through the door gap 35. Since the door frame 1 and the door panel 2 have outer faces lying in a common plane in the closed position on one side of the building door, the hollow profile of the door frame 1 has a setback into which the lip 17 engages in the closed position.

Since the design of the door hinge 3 is of crucial importance for such a building door, the construction of the door hinge 3 will be explained in more detail below.

FIGS. 2A and 2B show the building door in a sectional view, with FIG. 2A showing a cross section through the first hinge link 4 and FIG. 2B showing a cross section through the second hinge link 5. Since both the first door axis 11 of the first hinge link 4, and the second door axis 12 of the second hinge link 5 and the third hinge link 6, are inside the gap 35, it is necessary that the door axes 11, 12 be in front of a mounting plane 21 defined by the face of the door part 8 that bears against the door edge 9 when installed.

Figure 3:
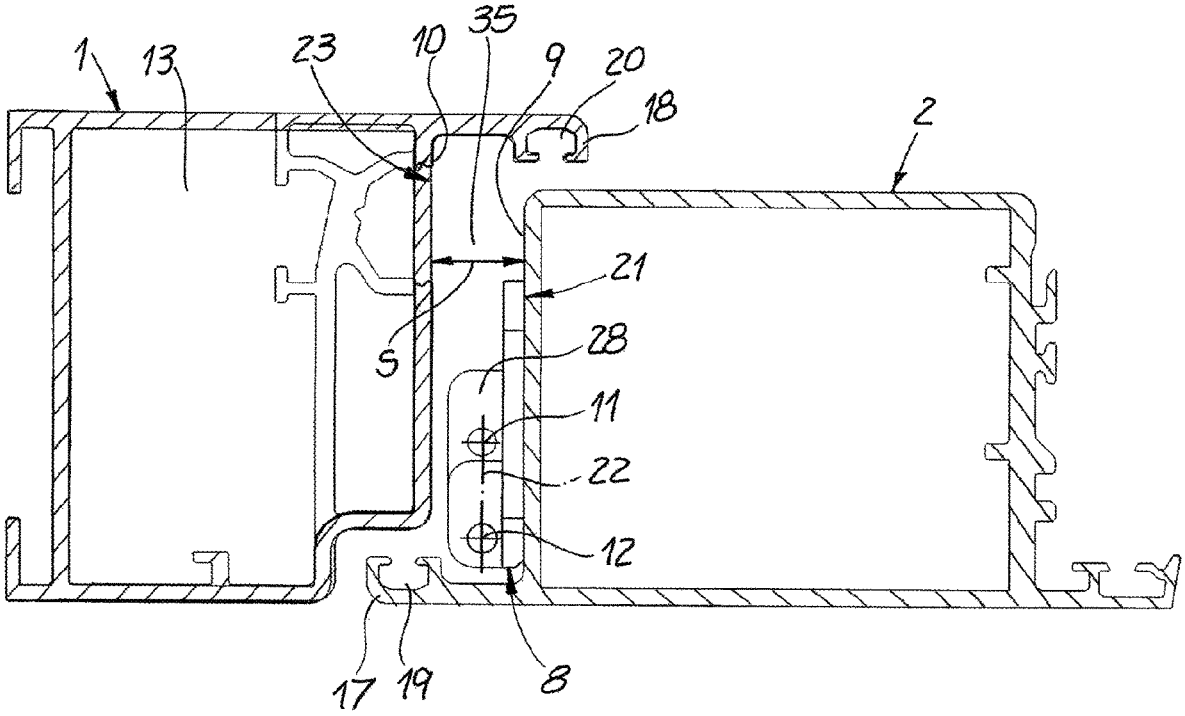
FIG. 3 is a section through the hinge assembly door according to FIG. 1 in which only the door part is represented by the door hinge.

In addition, the midpoints of the door axes 11, 12 define a connecting line 22 (FIGS. 4A and 4B) that, according to FIG. 3, runs in the gap 35 parallel to the mounting plane 21 and thus also parallel to the door edge 9 in the closed position. This ensures that the door part 8 is as compact as possible and can be fit within the door gap 35. The door part 8 is mounted on the door edge 9 here and fastened with a total of four screws in the example shown in FIG. 1.

Figure 4A:
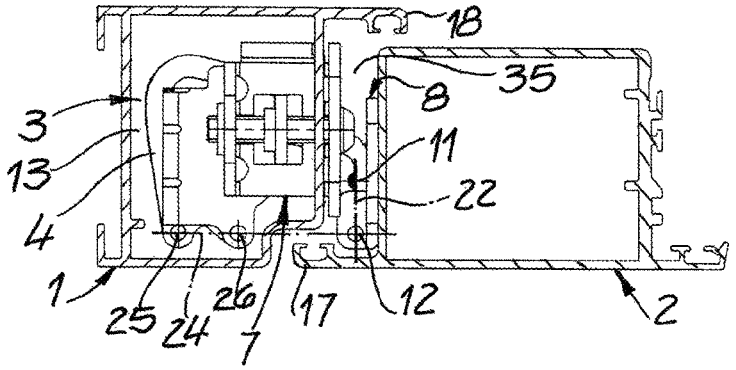
FIGS. 4A to 4C are top sectional views of the hinge assembly door according to FIG. 1 with the door hinge in three different positions.

As can be seen in particular from FIG. 4A but also from FIG. 2B, the door part 8 engages at least partially in the frame part 7, so that a negative spacing or overlap is formed between the frame part 7 and the door part 8.

Moreover, since the frame part 8 is completely within the door gap 35, the majority of the hinge links 4, 5, 6 must be inside the frame part 7 or within the frame-side cavity 13 in the closed position. For this purpose, the first hinge link 4 has a width $a_2$ that is the maximum extension along a second horizontal direction X of the first hinge link 4. The spacing $a_1$, on the other hand, describes the proportion of the width $a_2$ that is extends the second horizontal direction X behind a frame-side mounting plane 23. In the example shown, the ratio of $a_1$ to $a_2$ is 80%.

A corresponding ratio of $b_1$ to $b_2$ can also be determined for the second hinge link 5 and the third hinge link 6, this being 75%.

Figure 4B:
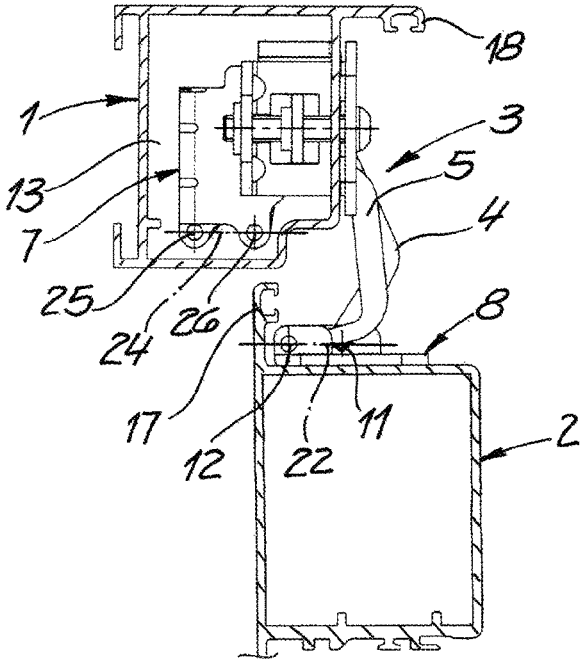
Figure 4C:
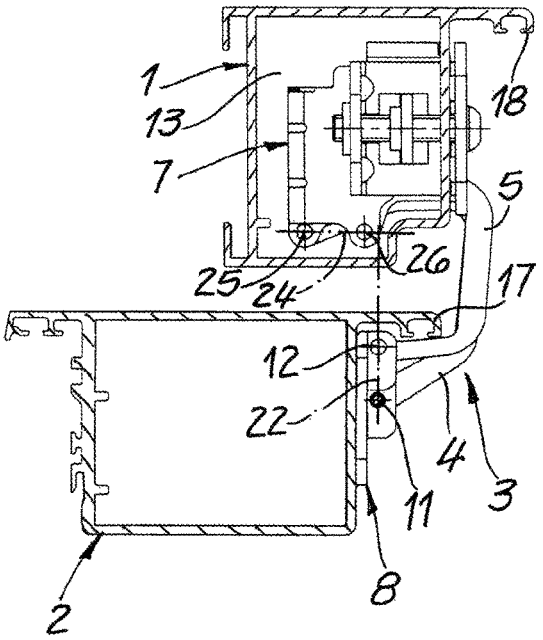

FIGS. 4A to 4C show the building door and, in particular, the door hinge 3 in opposite end positions.

According to FIG. 4A, the building door is completely closed, while FIG. 4C shows a fully opened building door, the opening angle being 180°. According to FIG. 4B, the building door is opened at an angle of 90°.

FIGS. 4A to 4C also show how the connecting line 22 between the door axes 11, 12 and the connecting line 24 between the frame axes 25, 26 behave relative to one another in different positions. Both in the closed position (FIG. 4A) and in a completely open position (FIG. 4C), the connecting lines 22, 24 are perpendicular to one another, with the point of intersection between the connecting lines 22, 24 passing through the second door axis 12 in the closed position. In a completely open position, the point of intersection shifts in the direction of the frame axes 25, 26 and lies just in front of the second frame axis 26. In an open position at 90°, the connecting lines 22, 24 are parallel to each other and therefore do not intersect.

Figure 5:
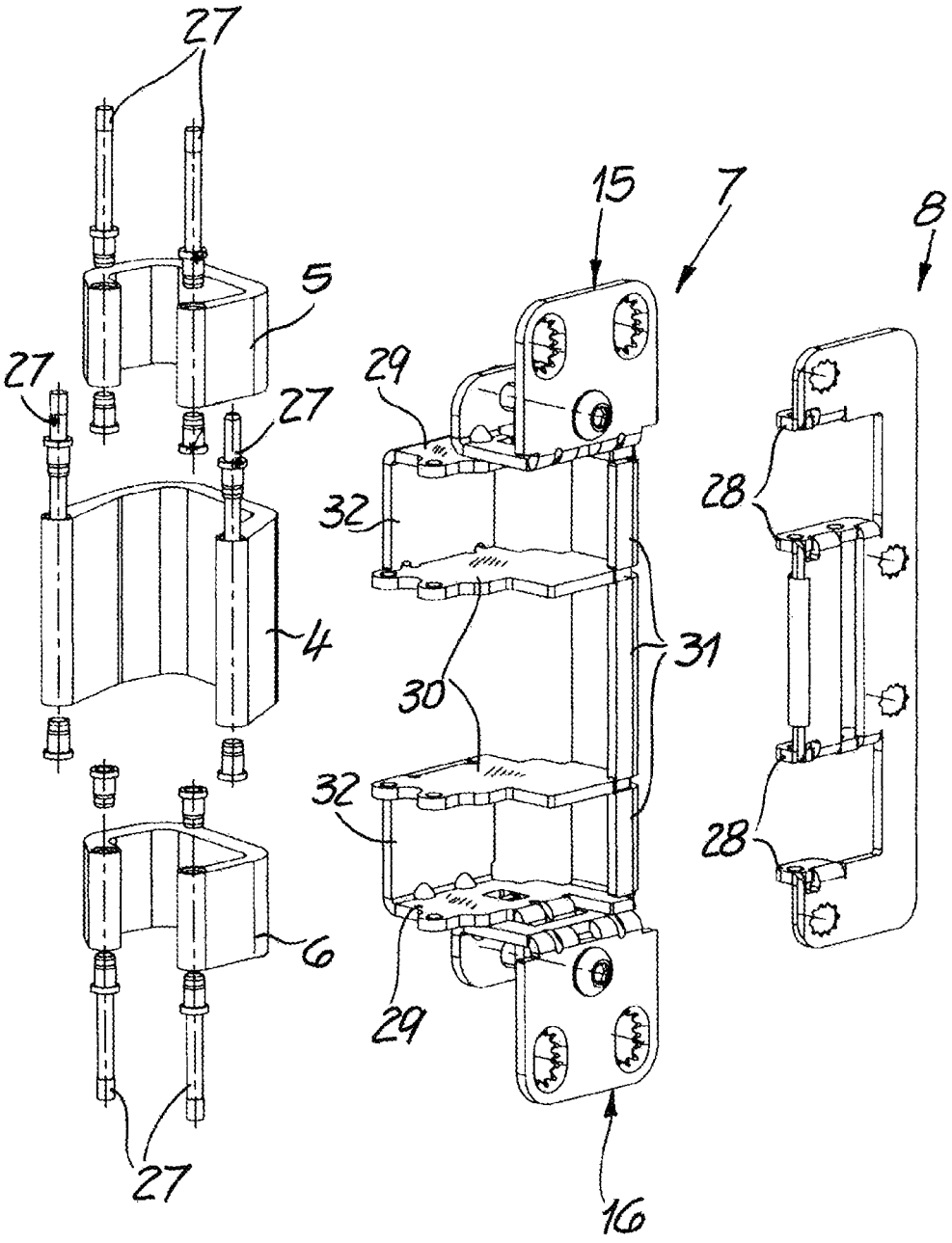
FIG. 5 is an exploded view of the door hinge.

The construction of the door hinge 3 can be seen in more detail in the exploded view of FIG. 5. In FIG. 5, the door part 8, the frame part 7, and the subassembly of the C-shaped hinge links 4, 5, 6 are shown separately. The hinge links 4, 5, 6 therefore have thickened portions at their ends, each with a hole at which the hinge links 4, 5, 6 are rotatably connected to the frame part 7 and the door part 8 by a plurality of pivot pins 27. The door part 8 has a plurality of perpendicular tabs 28 with holes for this purpose. Specifically, the two outer perpendicular tabs 28 each have one hole and the two middle perpendicular tabs 28 each have two holes, so that the hinge links 4, 5, 6 can be between the individual perpendicular tabs 28 and rotatably connected thereto by the respective pivot pins 27.

For attachment of the hinge links 4, 5, 6 on the frame-part side, the frame part 7 has two end walls 29 and two intermediate webs 30, with a hole being provided in each of the end walls 29 and two holes being provided in each of the intermediate webs 30. These holes are used for pivotally mounting the hinge links 4, 5, 6 by the respective pivot pins 27.

In order to impart a greater level of stability to the frame part 7, the end walls 29 and the intermediate webs 30 are connected by a side wall 31. In addition, two connecting webs 32 are provided of which a first connecting web 32 connects a first end wall 29 to a first intermediate web 30 and a second connecting web 32 connects a second end wall 29 to a second intermediate web 30. The intermediate webs 30 are not connected to one another by a connecting web 32, so that the frame part 7 is not closed at the rear in the area between the intermediate webs 30. This area receives the first hinge link 4, which is thus between the intermediate webs 30. Due to the lack of the rear wall, the first hinge link 4 is able to dip deeply into the frame-side cavity 13 and make optimum use of the available frame-side cavity 13.

In order to enable the door hinge 3 to be attached to the door frame 1, the frame part 7 has the mounting flanges 15 and 16 that extend vertically coplanar opposite each other from the frame part 7. The flanges 15 and 16 are, in turn attached to edges of the end walls 29. For this purpose, the end walls 29 each have a respective perpendicular tab that engages in a recess of the flanges 15 and 16. Subsequently, the mounting flanges 15 and 16 are connected to the end walls 29 by a screw.

Figure 6:
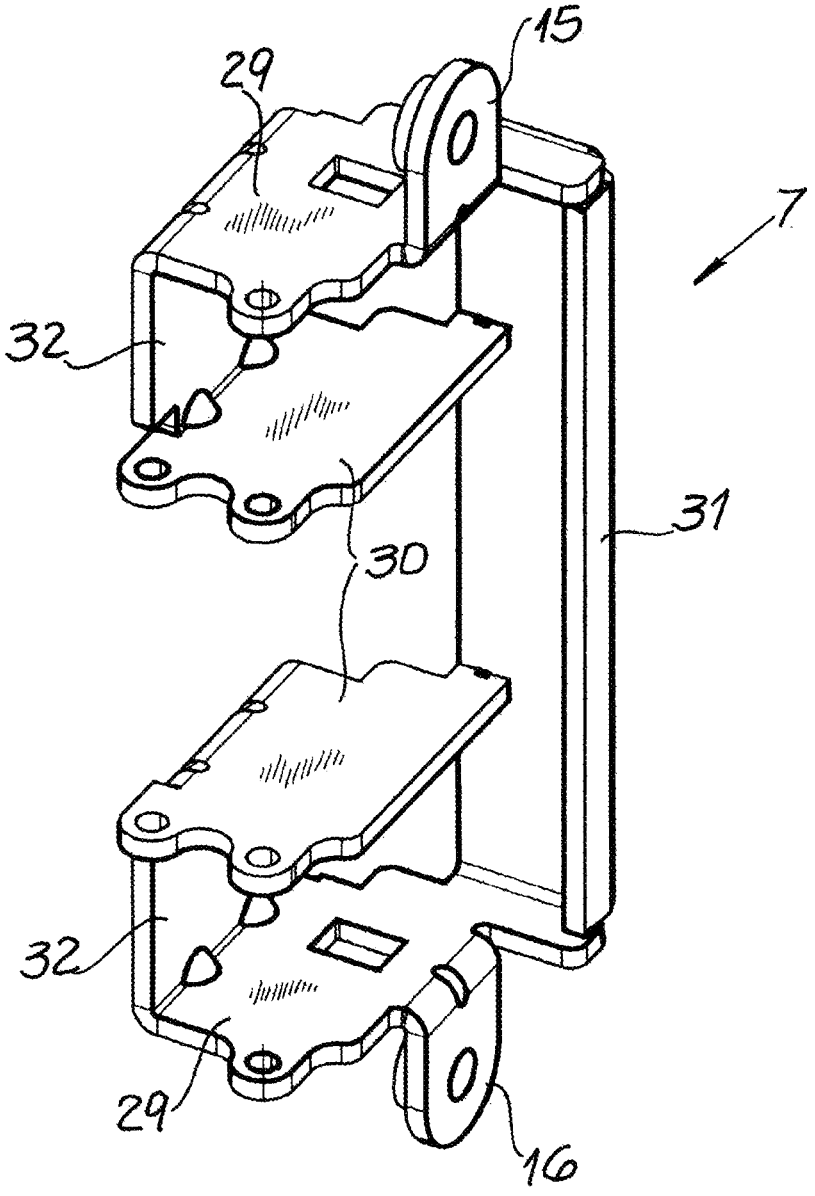
FIG. 6 is a perspective view of a one-piece door part for the door hinge.

FIG. 6 shows an alternative embodiment of the frame part 7 that is formed integrally with the frame part 7 shown in FIGS. 1 to 5. The frame part 7, in turn, has two mounting flanges 15 and 16 that are not formed on separate components, but rather directly on the one-piece door part 7. The end walls 29, in turn, have a perpendicular tab for this purpose, the mounting flanges 15 and 16 being formed by these perpendicular tabs. A hole is provided in each of the perpendicular tabs for attaching the frame part 7, so that the frame part 7 can be secured to a door frame with the aid of fasteners.

I claim:

1. A hinge for pivotally mounting a door panel having a door edge on a door frame having a frame edge juxtaposed with and confronting the door edge in a closed position of the door with the door and frame edges delimiting a gap, the hinge comprising:

a door part fixed to the door edge and defining first and second parallel door axes in the gap between the door edge and frame edge;

a frame part fixed to the frame edge and defining first and second parallel frame axes recessed in the door frame and offset from the gap;

a first link having one end pivoted on the door part at the first door axis and an opposite end pivoted on the frame part at the first frame axis;

a second link separate from the first link and having one end pivoted on the door part at the second door axis and an opposite end pivoted on the frame part at the second frame axis, whereby the door is pivotal from the closed position through at least 135° to an open position.

2. The hinge according to claim 1, wherein the door part is completely in the gap between door panel and door frame in the closed position.

3. The hinge according to claim 1, wherein the gap has a dimension measured perpendicular to a plane of the frame of less than 15 mm.

4. The hinge according to claim 1 wherein the door frame is a hollow profile.

5. The hinge according to claim 1, wherein the door panel is formed with a lip extending in a plane of the door panel across the gap in the closed position.

6. The hinge according to claim 5, wherein the lip is formed with a groove adapted to hold a seal engageable with a face of the frame in the closed position.

7. The hinge according to claim 5, wherein the frame is formed with a setback groove into which the lip engages in the closed position.

8. The hinge according to claim 1, wherein the door edge is formed with a planar mounting face extending parallel to the axes and to which the door part is fixed.

9. The hinge according to claim 8, wherein the door and frame parts are made of sheet metal.

10. The hinge according to claim 8, wherein a connecting line between midpoints of the first and second door axes is parallel to the mounting face.

11. The hinge according to claim 8, wherein a connecting line extending between midpoints of the first and second door axes forms an angle of 85° to 95° to the a connecting line between midpoints of the first and second frame axes in the closed position.

12. The hinge according to claim 8, wherein the gap has a horizontal dimension parallel to a plane of the door panel of at most 5 mm.

13. The hinge according to claim 8, wherein the frame part has at least one mounting flange that attaches the frame part to the frame edge.

14. The hinge according to claim 13, wherein at least 70% of a width of the first link and of a width of the second link is behind a mounting plane defined in the closed position by the mounting flange.

15. The hinge according to claim 1, wherein the door part is formed with tabs in which the first and second links are pivoted.

16. The hinge according to claim 15, wherein the frame part is formed with tabs in which the first and second links are pivoted.

17. The hinge according to claim 1, wherein the frame part is open away from the door panel such that in the closed position the links can dip into the frame part deeply.

18. The hinge according to claim 1, wherein the frame part is formed with oppositely vertically projecting flanges by which the frame part is fastened to the frame.

19. The hinge according to claim 1, wherein the frame part has horizontal upper and lower end walls having outer edges and mounting flanges extending vertically from the outer edges.

20. The hinge according to claim 1, wherein the frame part is formed as one piece.

* * * * *